US010179090B2

(12) United States Patent
Hammond et al.

(10) Patent No.: US 10,179,090 B2
(45) Date of Patent: Jan. 15, 2019

(54) PACKAGING

(71) Applicant: Multi Packaging Solutions UK Limited, Nottingham (GB)

(72) Inventors: Carol Lynn Hammond, Nottingham (GB); Nigel Davis, Nottingham (GB)

(73) Assignee: Multi Packaging Solutions UK Limited, Nottingham (GB)

( * ) Notice: Subject to any disclaimer, the term of this patent is extended or adjusted under 35 U.S.C. 154(b) by 427 days.

(21) Appl. No.: 14/919,301

(22) Filed: Oct. 21, 2015

(65) Prior Publication Data

US 2016/0120744 A1 May 5, 2016

(30) Foreign Application Priority Data

Nov. 3, 2014 (GB) ..... 1419536.6
Sep. 7, 2015 (GB) ..... 1515771.2

(51) Int. Cl.

| | |
|---|---|
| ***B65D 83/04*** | (2006.01) |
| ***A61J 1/03*** | (2006.01) |
| ***B65D 5/38*** | (2006.01) |
| *A61J 1/16* | (2006.01) |

(52) U.S. Cl.

CPC ..... *A61J 1/035* (2013.01); *B65D 5/38* (2013.01); *B65D 83/0463* (2013.01); *A61J 1/16* (2013.01)

(58) Field of Classification Search

CPC .... B65D 5/38; B65D 75/327; B65D 83/0463; B65D 2575/3227; B65D 2215/02; A61J 1/035; A61J 1/16

USPC ..... 206/1.5, 530, 531, 538, 539, 468; 229/125.125; 220/8

See application file for complete search history.

(56) References Cited

U.S. PATENT DOCUMENTS

| | | | | |
|---|---|---|---|---|
| 2,718,980 | A * | 9/1955 | Strom | B65D 43/0212 206/528 |
| 3,567,013 | A * | 3/1971 | Tannebaum | B65D 75/225 206/538 |
| 6,708,826 | B1 * | 3/2004 | Ginsberg | B65D 33/001 206/499 |
| 7,025,207 | B2 * | 4/2006 | Breu | B65D 75/36 206/531 |
| 7,617,935 | B2 * | 11/2009 | Reilley | A61J 7/00 206/1.5 |
| 2004/0026293 | A1 | 2/2004 | Hughes | |
| 2005/0173291 | A1 * | 8/2005 | Specker | B65D 5/2009 206/536 |
| 2006/0157374 | A1 | 7/2006 | DeJonge | |
| 2007/0068843 | A1 | 3/2007 | Hession | |
| 2008/0308449 | A1 * | 12/2008 | Intini | B65D 75/327 206/532 |
| 2010/0084308 | A1 * | 4/2010 | Rigby | B65D 83/0463 206/531 |

(Continued)

OTHER PUBLICATIONS

EP search report for EP15190862.1 dated Mar. 3, 2016.
UK search report for GB1419536.6 dated Jan. 9, 2015.

*Primary Examiner* — Luan K Bui
(74) *Attorney, Agent, or Firm* — O'Shea Getz P.C.

(57) ABSTRACT

A package includes a container made from a paperboard, cardboard or other foldable sheet material, and houses at least one blister pack. The blister pack is secured within an internal space of the container by means of a frangible connection, breakage of the frangible connection allowing complete removal of the blister pack from the container.

16 Claims, 5 Drawing Sheets

(56) References Cited

U.S. PATENT DOCUMENTS

2010/0213097 A1* 8/2010 Paliotta ..... B65D 5/4204
206/531

* cited by examiner

PACKAGING

This application is entitled to the benefit of and incorporates by reference essential subject matter disclosed in United Kingdom Application No. 1419536.6 filed on Nov. 3, 2014 and United Kingdom Application No. 1515771.2 filed on Sep. 7, 2015.

BACKGROUND OF THE INVENTION

1. Technical Field

The present invention relates to child resistant packaging, particularly child resistant pharmaceutical packaging.

Pharmaceutical products are frequently supplied in blister packs. A blister pack comprises one or more "blisters" which hold capsules, tablets or other items and whose face is sealed by a foil or other film. The blister contents are dispensed by the user pressing down on the blister, thereby pushing the contents of the blister out through the sealing film.

A problem with blister packs is, however, that the blister's contents may be dispensed quite easily by children. There have therefore been various proposals for making it more difficult for children to dispense contents from a blister pack, requiring some further conscious effort on the part of the user. One such proposal is disclosed in GB-A-2451850. In this proposal, the blister pack is slidably received between two panels. One of the panels has an opening for movably receiving a blister of the blister pack. The other panel has one or more dispensing openings aligned with the first panel opening, the first panel and the second panel slidably receiving the blister pack therebetween. A blocking member is provided which is selectively moveable between a blocking position and a dispensing position. In its blocking position the blocking member prevents movement of the blister into alignment with the dispensing opening, thereby preventing dispensing of the blister's contents through the dispensing opening, but in its dispensing position it permits the blister to be moved into alignment with said dispensing opening for dispensing the blister's contents.

While this provides good protection against a child dispensing the blister's contents, it is desirable to provide an additional level of protection.

Blister packs are normally supplied in an external package from which they must be removed to allow dispensing of the contents. The present invention seeks to provide a package of this type with improved child resistance.

BRIEF SUMMARY OF THE INVENTION

From a first aspect the invention provides a package comprising a container made from a paperboard, cardboard or other foldable sheet material, and housing at least one blister pack, the blister pack being releasably secured within an internal space of the container by means of a frangible connection, breakage of the frangible connection allowing complete removal of the blister pack from the container.

With such an arrangement, when the container is opened, the blister pack will not simply fall out of the container, but will require positive action by a user to pull the blister pack from the container so as to break the frangible connection.

Preferably the blister pack is mounted in or to a carrier which is connected to the container through the frangible connection. The blister pack and its carrier may then be removed from the container together by breaking the frangible connection.

Preferably the carrier is attached to an inner wall of the container. The frangible connection may then be formed at a joint between the carrier and the inner wall of the container, or at a position intermediate the inner wall of the container and the carrier.

The carrier may be formed as a separate part and attached, for example adhesively secured to a wall of the container. However, in other embodiments the carrier is formed integrally with the container, so as to facilitate manufacture.

The carrier may be formed as a single sheet, simply supporting the blister pack. In other arrangements, the carrier may be formed from two panels between which the blister pack is received.

In a preferred embodiment, the carrier may itself provide child resistance. Thus, for example, the carrier may be of a construction as shown in GB-A-2451850. In such a construction, a blister pack is slidably received between two panels. One of the panels has an opening for movably receiving a blister of the blister pack. The other panel has one or more dispensing openings aligned with the first panel opening, the first panel and the second panel slidably receiving the blister pack therebetween. A blocking member is provided which is selectively moveable between a blocking position and a dispensing position. In its blocking position the blocking member prevents movement of the blister into alignment with the dispensing opening, thereby preventing dispensing of the blister's contents through the dispensing opening, but in its dispensing position it permits the blister to be moved into alignment with said dispensing opening for dispensing the blister's contents. The blocking member may be displaceable out of engagement with an edge of the blister pack (for example as in the embodiment of FIG. 1 of GB-A-2451850) or slidable out of contact with blisters of the blister pack (for example as shown in the embodiment of FIG. 3 of GB-2451850).

In these arrangements, one of the carrier panels is preferably hingedly attached to an attachment panel forming at least a portion of the inner wall of the container by means of the frangible connection.

The attachment panel may extend over the fill depth of the inner wall of the container. However, in a preferred embodiment it extends only a part of the depth. This may have advantages in a further aspect of the construction described below.

In another embodiment, the carrier may comprise a sachet which contains the blister pack, the sachet being releasably secured within the container by the frangible connection. The sachet may be removed from the container and opened to access the blister pack.

The sachet may be suitably attached an inner wall of the container, or retained in an overlap between container walls.

The sachet material may be a polypropylene, polyethylene, PET or multi-layer laminate structured material.

The sachet may comprises a peripheral seal and the sachet be attached to the container at the seal. For example, the sachet may be of a tubular construction sealed at opposed ends, or a dual film envelope or wrap construction sealed on all four sides.

The seal may comprise perforations or other weakening means forming the frangible connection, allowing the sachet to be separated from container. Alternatively, a part of the container to which the sachet is attached may have the frangible connection.

The sachet may be attached, for example glued or heat sealed, to the container before the container is erected.

The external container may also comprise child resistant features.

In one embodiment, the container comprises a container body having an open end which is closed by a removable hood telescopically received over the open end of the container body. The container and the hood are formed with at least one pair of opposed flaps which are arranged to abut together edge to edge when the container body and hood are moved apart, thereby preventing the hood being removed from the container body. Opposed walls of the container body are formed with intermediate lines of weakness which allow the wall or walls of the container body having an abutment flap to be deformed inwardly to effect release of the abutment to allow the hood to be removed.

While opposed flaps may be formed on just one side wall of the container, in embodiments opposed flaps are provided on more than one wall, for example on opposed walls of the container.

The line of weakness may, for example, be a fold line, a crease line or a perforated line extending longitudinally of the container body.

The attachment panel of the blister pack carrier is preferably attached to a wall having an intermediate line of weakness. However, to avoid the attachment panel interfering with the removal of the container hood (by potentially obviating the effect of the line of weakness), the attachment panel of the blister pack carrier is attached to the wall on only one side of the line of weakness.

The invention also extends to a blank of paperboard, cardboard or other foldable sheet material comprising for making a container in accordance with the invention integrally with a blister pack carrier. From a further aspect, therefore, the invention provides a blank of paperboard, cardboard or other foldable sheet material comprising an array of side wall panels for erection into a container, a blister pack attachment panel attached to one edge of the array of panels and one or more blister carrier panels attached to the blister pack attachment panel along a frangible line of weakness, breakage of the frangible line of weakness separating the blister carrier panels from the blank.

In one embodiment, the array of panels comprises four panels connected together about parallel fold lines, the blister pack attachment panel being attached to one of the panels by a further parallel fold line.

At least one blister carrier panel is also preferably attached to the attachment panel by a further parallel fold line. If a further blister carrier panel is present, this may be attached to the blister carrier panel by a further parallel fold line.

Preferably an end panel of the array is formed with an intermediate line of weakness extending over at last part its length.

Most preferably the blister pack attachment panel is attached to the opposite end of the array of panels and is of such a width that it does not overlap the line of weakness when the container is erected.

BRIEF DESCRIPTION OF THE DRAWINGS

A preferred embodiment of the invention will now be described by way of example only, with reference to the accompanying drawings in which.

DETAILED DESCRIPTION OF THE INVENTION

Figure 1:
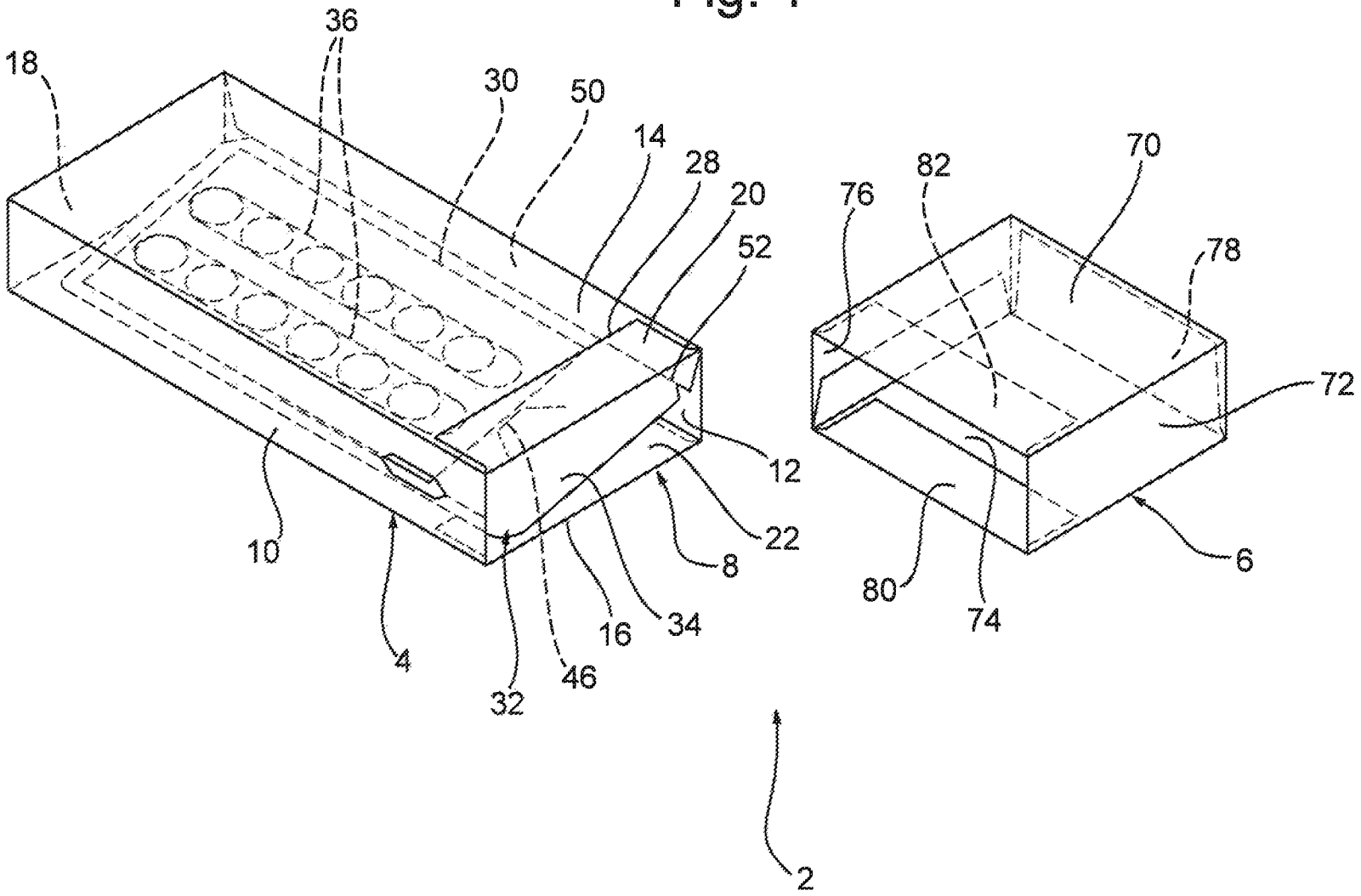
FIG. 1 shows a container in accordance with the invention with its hood removed.

With reference to FIG. 1, a container 2 in accordance with the invention comprises a container body 4 and a hood 6 which fits over the open end 8 of the container body 4 to close the container body 4.

The container body 4 includes opposed pairs of side walls 10, 12, 14, 16 and a further side, or end wall 18. Respective flaps 20, 22 are attached to the ends of the opposed side walls 14, 16 about respective fold lines 24, 26 and adhesively secured to the external surfaces of the side walls 14, 16. The free end of each flap 20, 22 forms an abutment 28, as will be described further below.

A blister pack 30 is housed within the internal space of the container body 4. The blister pack 30 is of a conventional construction comprising a blisters sheet having a series of blisters holding product such as pharmaceutical product and a frangible film closing the blisters and through which the product may be dispensed.

Figure 2:
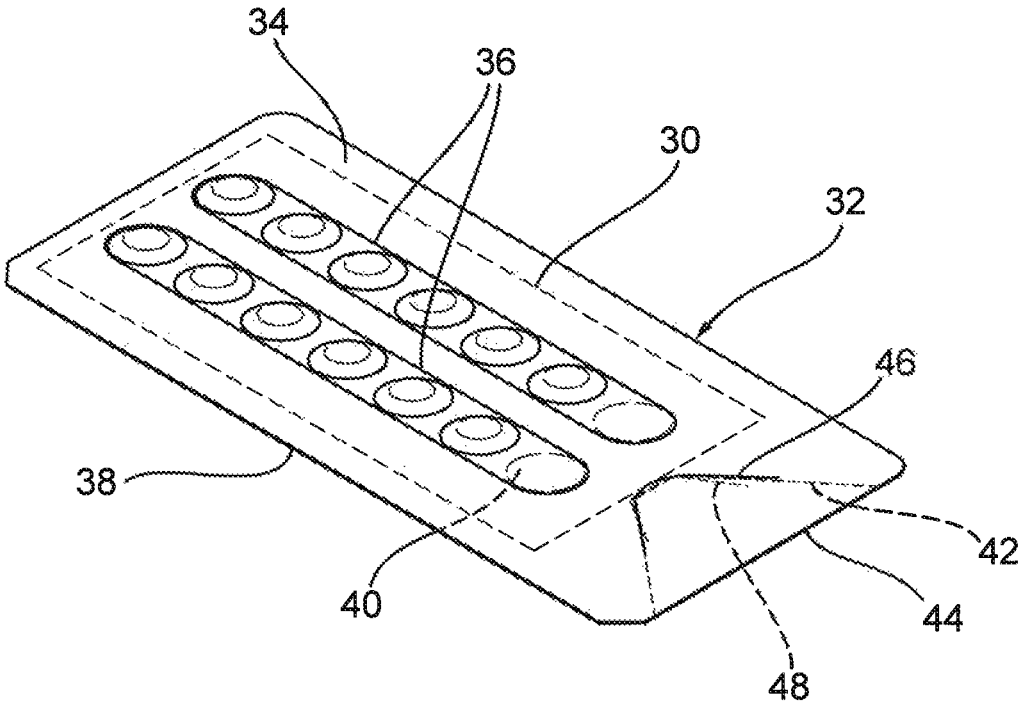
FIG. 2 shows the blister pack removed from the container of FIG. 1.

As is best illustrated in FIG. 2, the blister pack 30 is received in a blister pack carrier 32. The blister pack carrier 32 is of a construction similar to that disclosed in GB-A-2451850. As can be seen more clearly in FIG. 2, the blister pack carrier 32 includes a first panel 34 having a pair of parallel slots 36, and a second panel 38 having a plurality of dispensing openings defined by lines of weakness 40, e.g. perforations. A blocking element 42 is attached to one edge of the first panel 34 about a fold line 44 and located between the first and second panels 34, 38. Respective tabs 44, 46 are also provided in the first and second panels 34, 38. The first blister pack carrier panel 34 is attached to a blister pack attachment panel 50 along a fold line 52 formed with a series of cuts or perforations.

The blister pack attachment panel 50 is adhesively secured to the inner surface of one of the side wall panels 12. The side wall panel 12 and opposed side wall panel 10 comprise intermediate lines of weakness in the form of longitudinal fold lines crease lines, or even perforations 54 which extend from the open end 8 of the container body 4 for about half the length of each side wall 10, 12. The purpose of the fold or crease lines 54 is to facilitate the inward deformation of the side walls 10, 14 as will be described further below. To further assist in this, cut outs 56, 58 may be formed on the fold lines 54. The depth $d_1$ of the blister pack attachment panel 50 is less than the distance $d_2$ between the edge 60 of the side wall panel 12 such that when the blister pack attachment panel 50 is adhered to the side wall panel 12, it does not project over the fold line 54.

In this embodiment, the intermediate line of weakness 54 formed in the side wall panel 12 is arranged generally along the central axis of the sidewall panel 12. However, in other embodiments, this may be displaced towards the side wall panel 16. This will potentially allow the attachment panel 50 to be wider to provide a greater area of overlap with the blister pack attachment panel 50, leading to a stronger connection between the blister pack attachment panel 50 and the sidewall panel 12.

The hood 6 comprises side wall panels 70, 72, 74, 76 and an end closure 78. Flaps 80, 82 are attached to the side wall panels 70, 74 about fold lines 84, 86 and adhered onto the outer surface of the side wall panels 70, 74. The free end 88, 90 of each flap 80, 82 form abutments for engagement with the abutments 28 formed on the container body flaps 20, 22 such that when the hood 6 is placed over the container body 4, the abutments cooperate to prevent removal of the hood 6.

The erection and use of the container 2 will now be described.

Figure 3:
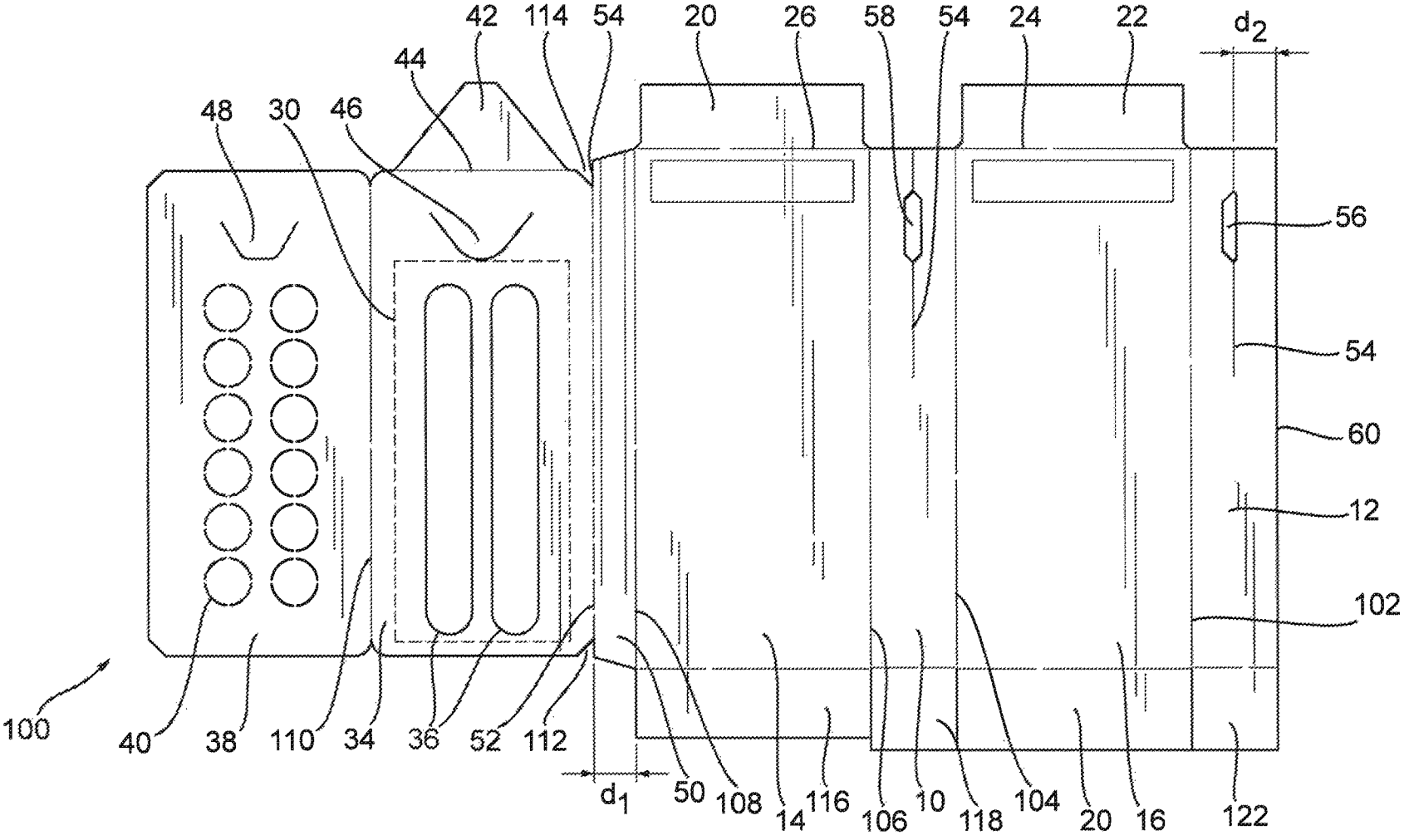
FIG. 3 shows a blank for making the container body of the container of FIG. 1.
Figure 4:
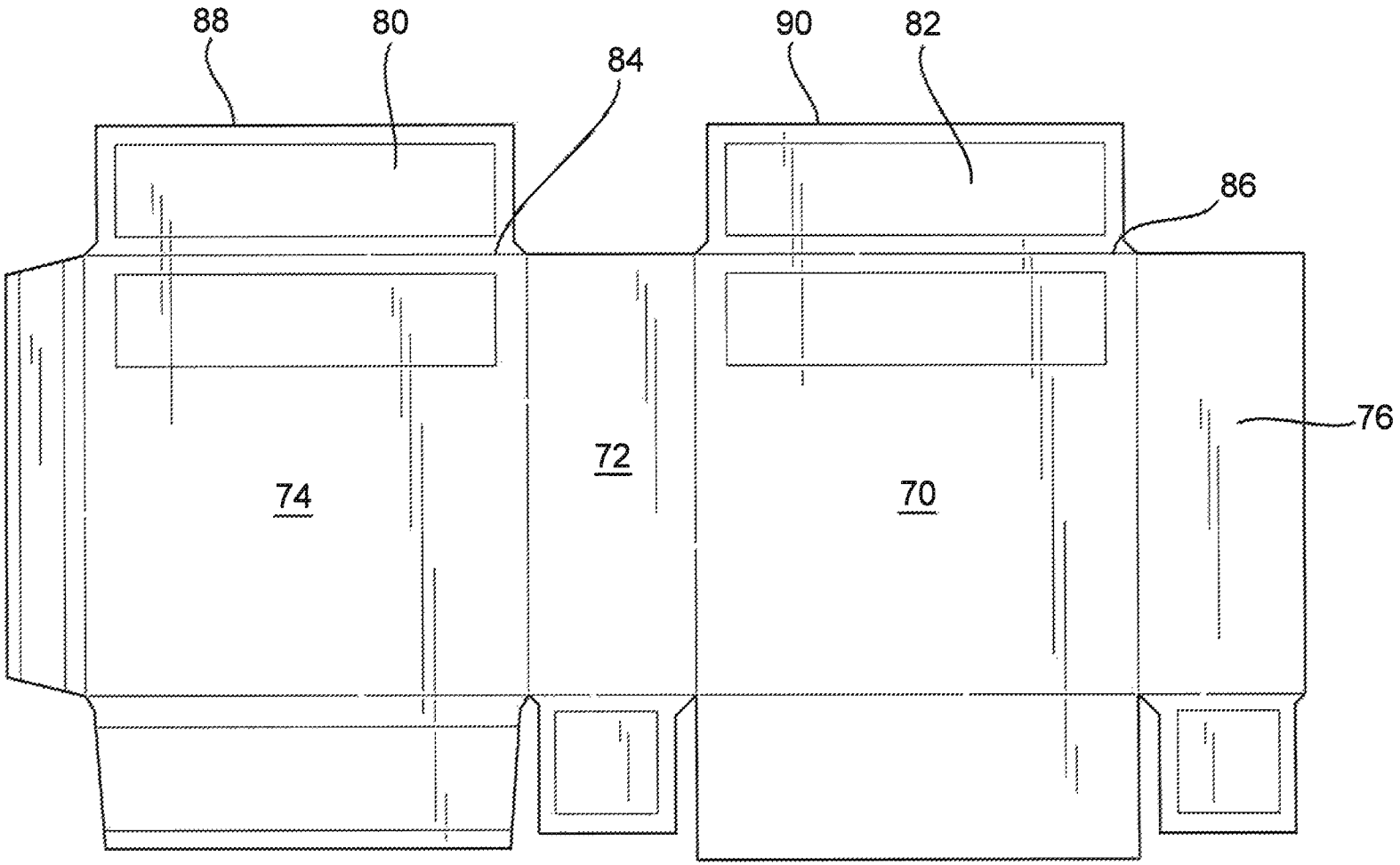
FIG. 4 shows a blank for making the hood of the container of FIG. 1.

As can be seen from FIG. 3, the container 2 is formed from a one-piece blank comprising a plurality of panels for forming the respective walls and panels of the container. For ease of reference the same reference signs have been used for the panels in the blank and the corresponding features in the container 2.

The blank 100 is formed of paperboard, cardboard or other lightweight sheet material and is formed with a series of parallel fold lines 102, 104, 106, 108, 110 which separate side wall forming panels 10, 12, 14, 16, the blister pack attachment forming panel 50 and the first and second blister pack carrier forming panels 34, 36. The first blister pack carrier forming panel 34 is attached to the blister pack attachment forming panel 50 by a frangible connection, in particular a perforated cut line 52. Notches 112, 114 are provided at either end of the cut line 52. Flap forming panels 20, 22 are attached to the ends of side wall forming panels 14, 16 about fold lines 24, 26. End wall forming flaps 116, 118, 120, 122 are attached to the lower end of the side wall forming panels 10, 12, 14, 16.

Fold lines 54 are formed in side wall forming panels 10, 12 with cut outs 56, 58 formed on both. The cut out 56 in side wall forming panel 12 does not extend significantly beyond the fold line 54.

To erect the blank 100, a blister pack 30 is first inserted with its blisters arranged within the slots 36 in the first blister pack carrier forming panel 34. The blocking member forming flap 42 is then folded about the hinge line 44 and adhered to the inner surface of the first blister pack carrier forming panel 34 such that its free end lies adjacent an edge of the blister pack 30. The second blister pack carrier forming panel 38 is then folded about hinge line 110 over the blister pack 30 and adhered around its periphery to the first blister pack carrier forming panel 34.

Flaps 20, 22 are then folded about hinge lines 24, 26 and adhered to the adjacent side wall forming panels 14, 16, and the side wall forming panels 10, 12, 14, 16 folded about fold lines 102, 104, 106 and 108 to a tubular configuration, with the blister pack attachment panel 50 lying inside the side wall forming panel 12. The blister pack attachment panel 50 is adhered to the inner surface of the side wall forming panel 12 such that it lies to one side of the fold line 54, in particular the side adjacent the free edge of that panel 12. Since the depth $d_1$ of the blister pack attachment panel 50 is less than the distance $d_2$ of the edge of the side wall panel from the fold line 54, the blister pack attachment panel 50 does not extend over the fold line 54. The absence of a cut out on that side of the fold line 54 provides improved adhesion of the blister pack attachment panel 50 in this region.

Finally the bottom closure flaps 116, 118, 120, 122 are folded over and glued to close one end of the container body 4.

The hood 6 is formed in a conventional manner by appropriate folding and gluing of the panels, with the flaps 80, 82 suitably folded and secured inwardly of the hood 6

Once the container body 4 and hood 6 have been erected and the hood 6 placed on the container body, as discussed above the abutments 28, 88, 90 prevent the hood from being simply removed from the container body, to make access to the blister pack more difficult. In order to do this, the user must squeeze inwardly on the side wall panels 10, 12. Due to the fold lines 54 and cut outs 56, 58 in those side walls, they allow the side walls 10, 12 to move together more easily, thereby allowing disengagement of the abutments 28, 88, 90 and removal of the hood 6.

Once the hood 6 has been removed, the user must take a further step to remove the blister pack 30 from the container body 4. He or she must grasp the end of the blister pack carrier 32 and pull it out of the container body 4. Pulling the blister pack carrier 32 in this way breaks the frangible connection retaining the blister pack 30 within the internal space of the container, namely the perforated cut line 52, between the blister pack carrier 32 and the blister pack attachment panel 50, allowing the blister card to be removed from the container body 4 in its carrier 32.

To dispense the contents of the blister pack 30, the user must depress the tab 46 in the carrier panel 34 to thereby deflect the blocking member out of alignment with the edge of the blister pack 30, thereby allowing the blister pack 30 to slide along the slots 36 to a position in which individual blisters align with the openings 40 in the carrier panel 38, to allow the blister contents to be dispensed therethrough.

Thus in this package three levels of protection are afforded to the user, namely the disengagement of the hood 6 from the container body 4, the removal of the blister pack carrier from the container body 4 and the dispensing of individual blister contents. Even after first use, two levels of protection are provided, i.e. the disengagement of the hood 6 from the container body 4 and the dispensing of individual blister contents. This makes accidental dispensing of the contents by a child unlikely.

The above embodiment is by way of example only and variations within the scope of the invention will be apparent to the skilled person. For example, the form of the blister pack carrier 32 may be different, for example as per the examples shown in GB-A-2451850. Thus instead of the blocking member being a tab which is pushed out of alignment with the edge of a blister pack, it may be one which is slidably displaced out of alignment with the blisters of the blister pack. What is important is the frangible connection of the carrier 32 to an attachment panel which retains the carrier 32 attached to the container body 4 until it is removed before first use.

In addition, rather than forming the blocking member as an integral part of the blister pack carrier blank, it may be formed as a separate piece and suitably positioned in the blister pack carrier during assembly.

Also, it may be possible to attach the attachment panel to a different side wall of the container body. The particular advantage of the arrangement shown is that the major fold lines needed to erect the container body are parallel, facilitating erection.

In addition, it may be possible or desirable to provide lines of weakness e.g. fold or crease lines to the side walls 14, 16 of the container body 4 in addition to those provided in the other walls 10, 12, depending on the particular dimensions of the container body 4.

Figure 5:
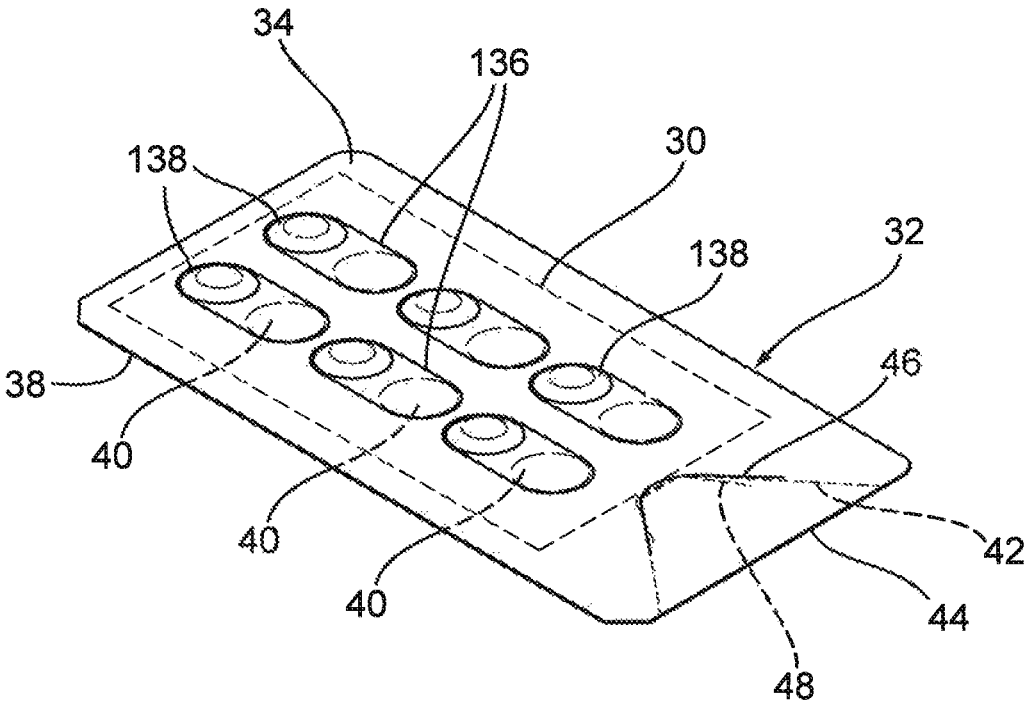
FIG. 5 shows an alternative form of blister carrier.

It should also be noted that although continuous slots 36 are illustrated in the embodiment above, it will be appreciated that shorter slots may be provided, for example associated with individual blisters 64. One such arrangement is illustrated in FIG. 5. Here, slots 136 accommodate individual blisters 138 rather than a row of blisters. It has been found that this may enhance child resistance, making it more difficult for a child to try to extract a blister pack via the slots in use.

Figure 6:
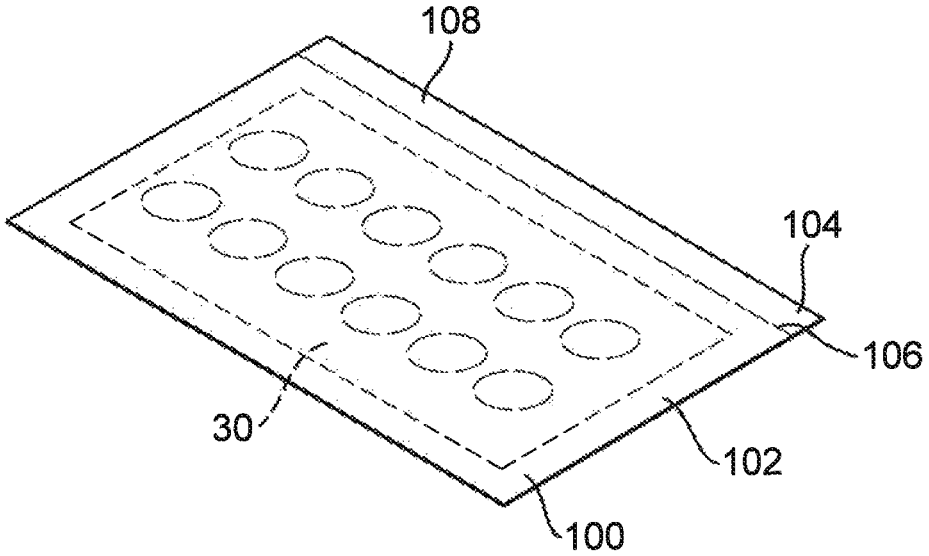
FIG. 6 illustrates a further embodiment of the invention.

In an alternative embodiment, as illustrated in FIG. 6, a blister pack 30 may be received within a sachet 100. The blister pack 30 may be a simple blister strip, or it may be mounted in a dispensing carrier, such as illustrated in GB-A-2451850 and as discussed in relation to the first embodiment above.

The sachet 100 may be made from any suitable material, for example polypropylene, polyethylene, PET or a multi-layer laminate structured material.

The sachet 100 is formed with a peripheral seal region 102 which in this embodiment extends around all sides of the sachet 100. In other embodiments, for example where the sachet is formed from a tubular material, the seal may be provided just at opposed ends of the sachet 100.

One side 104 of the peripheral seal is provided with a perforation 106 or other line of weakness extending along its length. The portion 108 of the side seal 104 outboard of the perforation 106 is suitably attached, for example by gluing or heat sealing, to the container for securing the sachet 100 within the container.

The side seal 104 may, for example, be attached to an inwardly facing surface of the blister pack attachment panel 50 illustrated in FIG. 1. Alternatively, the side seal may be retained in the seal between the panel 50 and the underlying container body side wall 12. The sachet can then be removed by breaking the frangible connection 106, allowing the sachet 100 to be opened and the blister pack removed.

In an alternative arrangement, the sachet 100 may be attached to a panel of the container body which is provided with the frangible connection, whereby the sachet and a portion of the panel will be removable by breaking the frangible connection.

Although this invention has been shown and described with respect to the detailed embodiments thereof, it will be understood by those skilled in the art that various changes in form and detail may be made without departing from the spirit and scope of the invention.

What is claimed is:

1. A package comprising a container made from a paperboard, cardboard or other foldable sheet material, and housing at least one blister pack, the blister pack being secured within an internal space of the container by means of a frangible connection, breakage of the frangible connection allowing complete removal of the blister pack from the container, wherein the blister pack is mounted in or to a carrier which is connected to the container through the frangible connection, wherein the carrier comprises a first carrier panel and a second carrier panel between which the blister pack is received, wherein one of the first and second carrier panels has a panel opening for movably receiving a blister of the blister pack and the other of the first and second carrier panels has one or more dispensing openings aligned with the panel opening, the first carrier panel and the second carrier panel slidably receiving the blister pack therebetween, and further comprising a blocking member which is selectively moveable between a blocking position in which it prevents movement of the blister into alignment with the dispensing opening, and a dispensing position in which it permits the blister to be moved into alignment with the dispensing opening for dispensing the blister's contents.

2. A package as claimed in claim 1, wherein the carrier is attached to an inner wall of the container.

3. A package as claimed in claim 2, wherein the frangible connection is formed at a joint between the carrier and the inner wall of the container.

4. A package as claimed in claim 2, wherein the frangible connection is formed at a position intermediate the inner wall of the container and the carrier.

5. A package as claimed in claim 1, wherein the carrier is formed integrally with the container.

6. A package as claimed in claim 2, wherein the carrier is attached, by means of the frangible connection, to an attachment panel forming at least a portion of the inner wall of the container.

7. A package as claimed in claim 6, wherein the attachment panel extends only over a part of the depth of the container inner wall.

8. A package as claimed claim 1 wherein, the carrier comprises a sachet which contains the blister pack, the sachet being releasably secured within the container by the frangible connection.

9. A package as claimed in claim 8, wherein the sachet is attached to an inner wall of the container.

10. A package as claimed in claim 8, wherein the sachet is retained in an overlap between container panels.

11. A package as claimed in claim 8, wherein the sachet comprises a peripheral seal and the sachet is attached to the container at the seal, wherein the seal comprises perforations or other weakening means forming the frangible connection.

12. A package comprising a container made from a paperboard, cardboard or other foldable sheet material, and housing at least one blister pack, the blister pack being secured within an internal space of the container by means of a frangible connection, breakage of the frangible connection allowing complete removal of the blister pack from the container, wherein the package comprises a container body having an open end which is closed by a removable hood telescopically received over the open end of the container body, wherein the container body and the hood are formed with opposed flaps which are arranged to abut together edge to edge when the container body and hood are moved apart, and wherein opposed walls of the container body are formed with intermediate lines of weakness which allow those walls to be deformed inwardly to effect release of the abutment to allow the hood to be removed.

13. A package as claimed in claim 12, wherein the line of weakness is a fold line, crease line or a perforated line extending longitudinally of the container body.

14. A package as claimed in claim 12, wherein the carrier is attached, by means of the frangible connection, to an attachment panel forming at least a portion of the inner wall of the container and wherein the attachment panel of the blister pack carrier is attached to a wall having an intermediate line of weakness.

15. A package as claimed in claim 14, wherein the attachment panel of the blister pack carrier is attached to the wall on only one side of the line of weakness.

16. A package as claimed in claim 12 wherein at least one intermediate line of weakness is displaced from a center line of the respective wall panel.

* * * * *